US005437315A

United States Patent [19]

Ward

[11] Patent Number: 5,437,315

[45] Date of Patent: Aug. 1, 1995

[54] MULTILAYER FORMING FABRIC

[75] Inventor: Kevin J. Ward, Kentville, Canada

[73] Assignee: Huyck Licensco, Inc., Wilmington, Del.

[21] Appl. No.: 208,635

[22] Filed: Mar. 9, 1994

[51] Int. Cl.[6] ..... D03D 23/00

[52] U.S. Cl. ..... 139/383 A; 428/225; 428/257

[58] Field of Search ..... 139/383 A; 428/225, 428/257

[56] References Cited

U.S. PATENT DOCUMENTS

| | | | |
|---|---|---|---|
| 4,438,789 | 3/1984 | MacBean | 139/383 A |
| 4,469,142 | 9/1984 | Harwood | 139/383 A |
| 4,515,853 | 5/1985 | Borel | 428/257 |
| 4,815,499 | 3/1989 | Johnson | 139/383 A |
| 4,987,929 | 1/1991 | Wilson | 139/383 A |
| 5,067,526 | 11/1991 | Herring | 139/383 A |
| 5,169,709 | 12/1992 | Fleischer | 139/383 A |
| 5,219,004 | 6/1993 | Chiu | 139/383 A |
| 5,277,967 | 1/1994 | Zehle et al. | 139/383 A |

*Primary Examiner*—James J. Bell
*Attorney, Agent, or Firm*—Lorusso & Loud

[57] ABSTRACT

A triple layer papermaking fabric in which the sheet side cross machine direction yarn knuckle drops below the surface of the top fabric layer at the point that the stitch yarn engages a machine direction yarn of the top fabric layer. Thus, drainage is retained at the point on the top fabric layer that the stitch yarn engages it, irrespective of the diameter of the yarns of the top fabric layer.

5 Claims, 5 Drawing Sheets

MULTILAYER FORMING FABRIC

BACKGROUND OF THE INVENTION

This invention relates to papermakers' fabrics and especially to papermaking fabrics for the forming section of a papermaking machine.

In the conventional papermaking process, a water slurry or suspension of cellulose fibers, known as the paper "stock", is fed onto the top of the upper run of a traveling endless forming belt. The forming belt provides a papermaking surface and serves as a filter element to separate the aqueous medium from the cellulosic fibers by providing for the drainage of the aqueous medium through its mesh openings, also known as drainage holes, by vacuum means or the like located on the drainage side of the fabric to form the paper web. The bottom side of the forming belt contacts the papermaking machine elements, and thus must be resistant to abrasion for long fabric life.

After leaving the forming medium, the somewhat self-supporting paper web is transferred to the press section of the machine and onto a pres felt, where still more of its water content is removed by passing it through a series of pressure nips formed by cooperating press rolls, these press rolls serving to compact the web as well.

Subsequently, the paper web is transferred to a dryer section where it is passed about and held in heat transfer relation with a series of heated, generally cylindrical rolls to remove still further amounts of water therefrom.

Over the years, papermakers have sought improvements in the forming fabric, not only with respect to the operating life of the fabric, but also with respect to the quality of the paper sheet produced on it. Triple layer fabrics were introduced for this purpose. The triple layer fabric generally includes two distinct fabrics. The top fabric has a top surface designed specifically for papermaking to achieve the best possible sheet quality and machine efficiency. This top fabric is manufactured as an integral part of a woven structure with a completely separate bottom fabric designed specifically for mechanical stability and enhanced fabric life. The purpose of triple layer fabric development is to eliminate the compromises between optimizing papermaking surface or fabric life which exist with both single and double layer forming fabrics. With a triple layer fabric, papermakers can produce a top quality paper sheet at reduced cost, without sacrificing the wear characteristics of the papermaking fabric.

To produce a fine top quality paper sheet, a papermakers' fabric with fine sheet side yarns in the top fabric layer will be chosen. A fine uniform top fabric layer in the papermaking fabric will give a more uniform initial fiber mat than a coarse, nonuniform top fabric layer. This degree of fineness and uniformity influences subsequent layers of fiber as the sheet is formed, and eventually, the paper sheet produced. Triple layer fabrics of this design provide a high open area and fiber support to produce premium quality and high drainage capacity.

While triple layer fabrics with fine sheet side yarns have demonstrated success in numerous applications, other applications exist where somewhat coarser triple layer designs are preferred. A coarser triple layer fabric can be made using larger machine direction yarns on the sheet side. However, the use of larger warp yarns has been found to offer no advantage. Alternatively, a coarser triple layer fabric can be made using the same fine triple layer machine direction yarns but using coarser sheet side cross machine direction yarns.

For example, a triple layer fabric having 73 epi of 0.16 mm machine direction yarns, 80 ppi of 0.13 cross machine direction yarns and a plain weave top has an open area of 31.9%. Similarly, a fabric having 73 epi of 0.13 machine direction yarns and 80 ppi of 0.16 mm cross machine direction yarns has the same open area. Theoretically, then, the same fabric is produced.

The use of larger cross machine direction yarns instead of the larger machine direction yarns produces useful fabric properties. Edge curl of the fabric is controlled to a degree when larger cross machine direction yarns are used. Other benefits include improved warp stacking uniformity and paper making characteristics. The wire mark imparted to the paper made on a fabric with larger cross machine direction yarns is more evident, and therefore the paper inferior to that made on fabric with larger machine direction yarns using conventional stitching. This fact is especially true at higher cross machine direction yarn counts. An inferior paper sheet can be explained by the reduced drainage capacity of the fabric due to a blockage of holes at each sheet side stitch interlace.

The blockage can be seen with reference to the fabrics described above and FIGS. 1 and 2 showing prior art fabrics 10 and 15 in which the machine direction yarns are designated by reference number 11, cross machine direction yarns by reference number 13 and stitch yarns by reference number 14. As shown in FIG. 1, at 80 ppi with a 0.16 mm sheet side cross machine direction yarn 13 and a 0.13 mm stitch yarn 14, the stitch blocks approximately 83% of two holes at each interlace. Meanwhile, at 80 ppi with a 0.11 mm sheet side cross machine direction yarn 13 and a 0.13 mm stitch yarn 14, the stitch blocks only 63% of two adjacent holes, as shown in FIG. 2. The interrelation between hole blockage on the top picks per inch and sheet side fill yarn sizes with a 0.13 mm stitch is shown in FIG. 3.

Blockage of this type can cause a wire mark, on the forming paper sheet, which degrades the quality of the paper produced. The term "wire mark" is used to explain the micro or finer levels of density difference, often caused by the structure of the forming fabric on which the sheet is produced.

There has long been a need to produce a papermakers' fabric that combines good drainage ability with an optimal paper sheet surface. This is especially true when the application calls for a coarse triple layer fabric.

It is therefore an object of the present invention to prepare a papermaking fabric for the forming section of the papermaking machine.

Another object of the present invention is to provide a papermaking fabric that combines good drainage capability with an optimal paper sheet surface in a coarse triple layer fabric.

A further object of the present invention is to provide a papermaking fabric with good wear life and abrasion resistance that produces a paper sheet with optimal printing properties.

It is a further object of the present invention to allow flexibility in the selection of yarn dimensions and still retain optimum drainage capacity of the papermakers' fabric.

SUMMARY OF THE INVENTION

According to the present invention, a triple layer papermakers' fabric is provided, in which the sheet side cross machine direction yarn knuckle adjacent to the stitch yarn knuckle is dropped so that the stitch yarn knuckle replaces the knuckle of the sheet side cross machine direction yarn at that point. This configuration eliminates the risk of hole blockage at the point the two fabric layers are stitched together, even with use of wider dimension structural cross machine direction yarn, so that the fabric designer has greater flexibility in selecting yarns for the top fabric layer and paper producing properties of the triple layer fabric as a whole can be optimized.

DETAILED DESCRIPTION OF THE INVENTION

Figure 1:
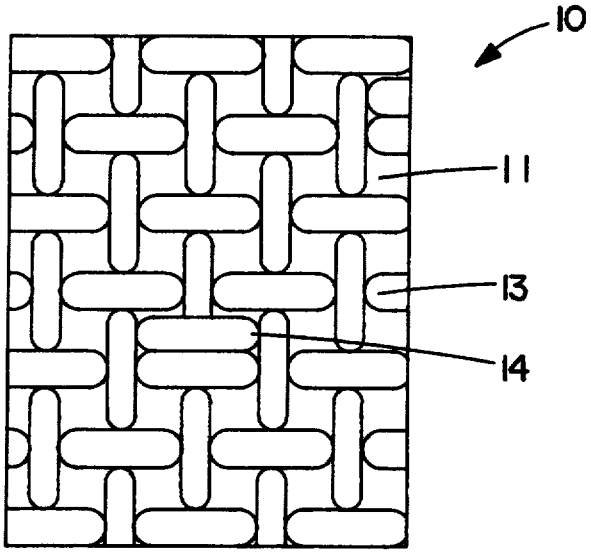
FIG. 1 PRIOR ART
FIG. 1 is a top view of the sheet side of a prior art triple layer papermakers' fabric.
Figure 2:
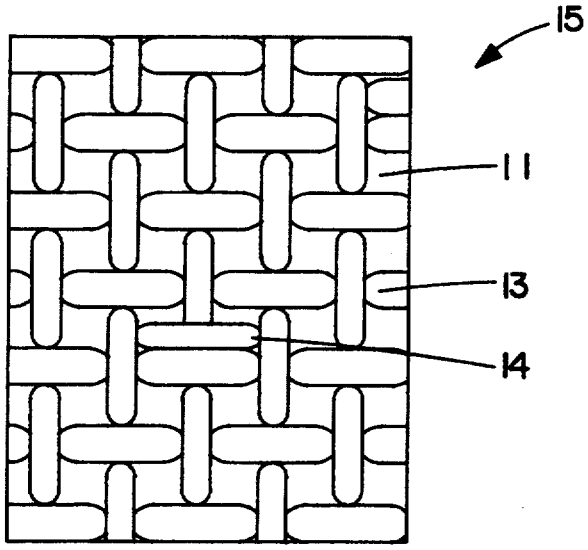
FIG. 2 PRIOR ART
FIG. 2 is a top view of the sheet side of another prior art triple layer papermakers' fabric.
Figure 3:
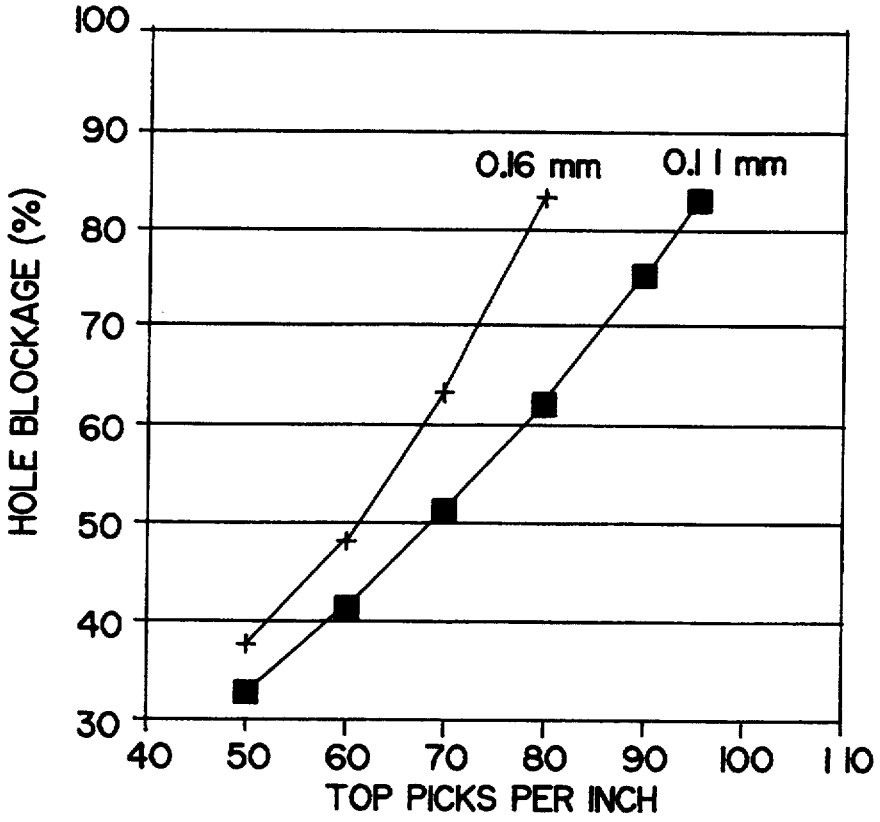
FIG. 3 is a graph illustrating the dependence of hole blockage on the top cross machine direction yarns and picks per inch and the sheet side fill yarn sizes, using a 0.13 mm stitch yarn.

The present invention allows for greater flexibility in designing a triple layer papermaking fabric in that the fabric designer is not restricted to fine top layer yarns to achieve an optimal papermaking surface. A uniform papermaking surface and adequate drainage can be obtained in a fabric utilizing the concepts of the present invention, irrespective of the size of the machine direction and cross machine yarns chosen. According to the present invention, a sheet side cross machine direction yarn knuckle is dropped at every point in the top fabric layer in which that fabric layer will be stitched with a stitch yarn. The stitch yarn replaces the sheet side cross machine direction yarn in the weave of the top fabric layer at that point. Accordingly, hole blockage at each point is reduced.

The concepts of the present invention can be utilized with any triple layer papermaking fabric, that is, a papermaking fabric having a top fabric layer and a bottom fabric layer connected by a binder or stitch yarn. A fabric designer can select any weave top fabric layer and any weave bottom fabric layer to make up the layers of the triple layer fabric. Similarly, the pattern of binding can be designed according to the ultimate needs of the final papermaking fabric, and that factor is left to those skilled in the art.

The yarns utilized in the fabric of the present invention will vary depending upon the desired properties of the final papermaking fabric, and of the paper sheet to be formed on that fabric. For example, the yarns may be multifilament yarns, monofilament yarns, twisted multifilament or monofilament yarns, spun yarns or any combination of the above. It is within the skill of those practicing in the relevant art to select one or more yarn types, depending on the purpose of the desired fabric, to utilize with the concepts of the present invention.

Yarns types selected for use in the fabric of the present invention may be those commonly used in papermaking fabrics. The yarns can be polypropylenes, polyesters or polyamides. Again, one skilled in the relevant art will select a yarn material according to the particular application of the final triple layer fabric. A commonly used yarn which can be incorporated to great advantage in weaving fabrics in accordance with the present invention is a polyester monofilament yarn, sold by Hoechst Celanese Fiber Industries under the trademark, TREVIRA.

The bottom fabric layer of the triple layer papermaking fabric of the present invention will be any fabric with a weave and yarn types chosen for wear and abrasion characteristics of the fabric layer. One skilled in the art can select a fabric to suit the particular needs at hand. The preferred fabric for the bottom fabric layer is a 5 harness base 2 weave having machine direction yarns with a diameter of 0.20 to 0.22 mm and cross machine direction yarns with a diameter of 0.23 to 0.32 mm.

The top fabric layer for the triple layer papermaking fabric of the present invention will be any fabric chosen for its papermaking surface qualities. One of the advantages of the present invention, however, is that the top fabric layer need not be restricted to the use of fine yarns, and coarse fabric layer designs can be incorporated successfully into the concept of the present invention. The preferred top fabric layer for use in the fabric of the present invention is a plain weave incorporating machine direction yarns with a diameter of 0.12 to 0.14 mm and cross machine direction yarns with a diameter of 0.11 to 0.16 mm.

The stitch yarn utilized in the present invention will generally be 0.12 to 0.14 mm in diameter. In the fabric of the present invention, the stitch yarn will generally travel in the cross machine direction.

The preferred embodiment for a fabric woven according to the present invention incorporates the following: a plain weave top fabric layer, a 5 harness (base 2) weave bottom fabric layer, a 3:2 ratio of top to bottom cross machine direction yarns and a stitch yarn after every three top cross machine direction yarns. This preferred embodiment will have 73 finished ends per inch (each) of 0.13 and 0.21 mm high modulus polyester machine direction yarns on the sheet side and machine side respectively; 60 to 95 finished picks per inch of 0.11 to 0.16 mm regular modulus polyester sheet-side cross machine direction yarns; 40 to 63 finished picks per inch of 0.23 to 0.32 mm low modulus polyester machine-side cross machine direction yarns; and 20 to 32 woven picks per inch of 0.11 to 0.13 mm low or regular modulus polyester stitch yarns running in the cross machine direction.

While this embodiment has excellent characteristics for papermaking, other embodiments of the present invention produce desirable characteristics for a triple layer papermakers' fabric. For example, triple layer fabrics having plain weave tops with 5 harness bottoms and 1:1 top to bottom weft ratios stitched after either two or four weft yarns show good qualities.

Figure 4:
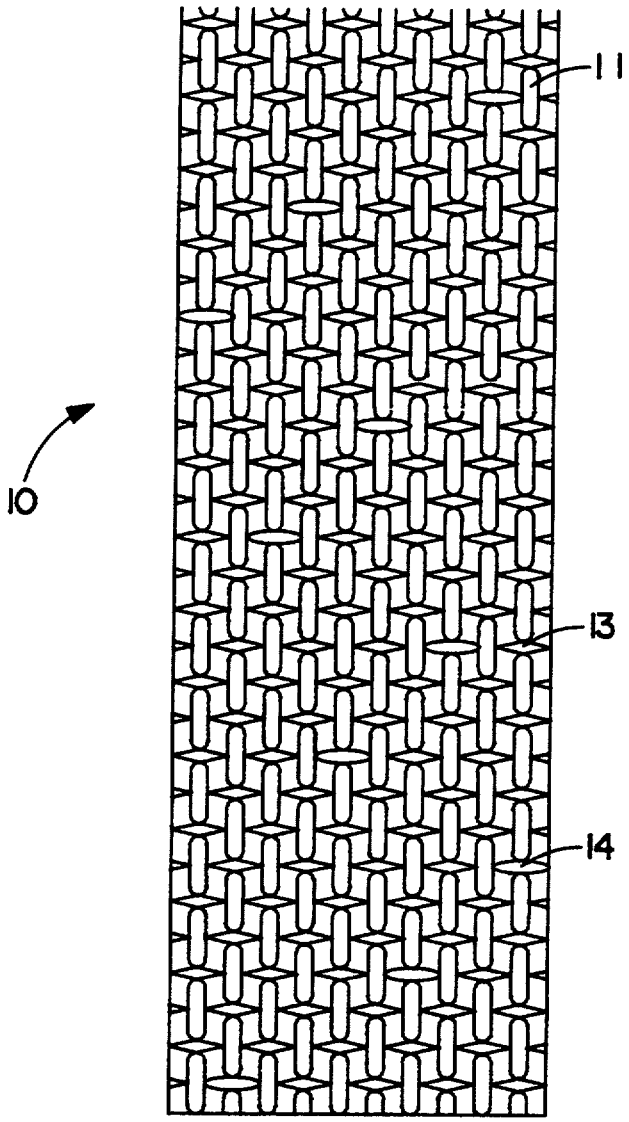
FIG. 4 is a sheet side view of a preferred embodiment of a papermakers' fabric according to the present invention.

Turning to the figures, FIG. 4 shows a sheet side view of the top fabric layer 10 of a preferred embodiment of a papermaking fabric according to the present invention. As can be seen in that view, at every point that the stitch yarn 14 ascends to the top fabric layer, and crosses over a top fabric layer machine direction yarn 11, the cross machine direction yarn 13 that would normally bind the top fabric layer machine direction yarn 11 remains below the surface of the top fabric layer 10. A stitch yarn 14 knuckle replaces the knuckle of the cross machine direction yarn 13 at that point, and therefore the drainage hole is blocked by only one yarn knuckle, rather than two knuckles. Accordingly, drainage reduction is minimized.

Figure 5:
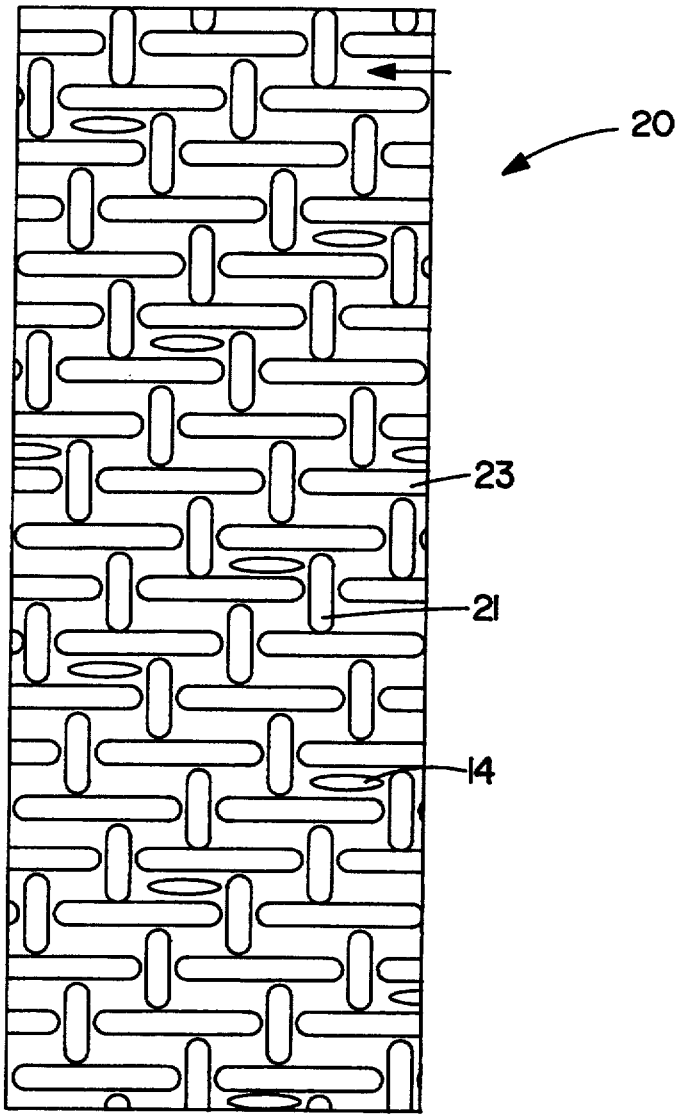
FIG. 5 is a view of the bottom surface of the fabric shown in FIG. 4.

The machine side surface of the bottom fabric layer 20 of the papermaking fabric shown in FIG. 4 is illustrated in FIG. 5 and shows no alterations made to the weave of the bottom fabric layer at the stitch point. The stitch yarn is indicated as reference number 14, with bottom fabric layer cross machine direction yarns as 23 and bottom fabric layer machine direction yarns as 21.

Figure 6:
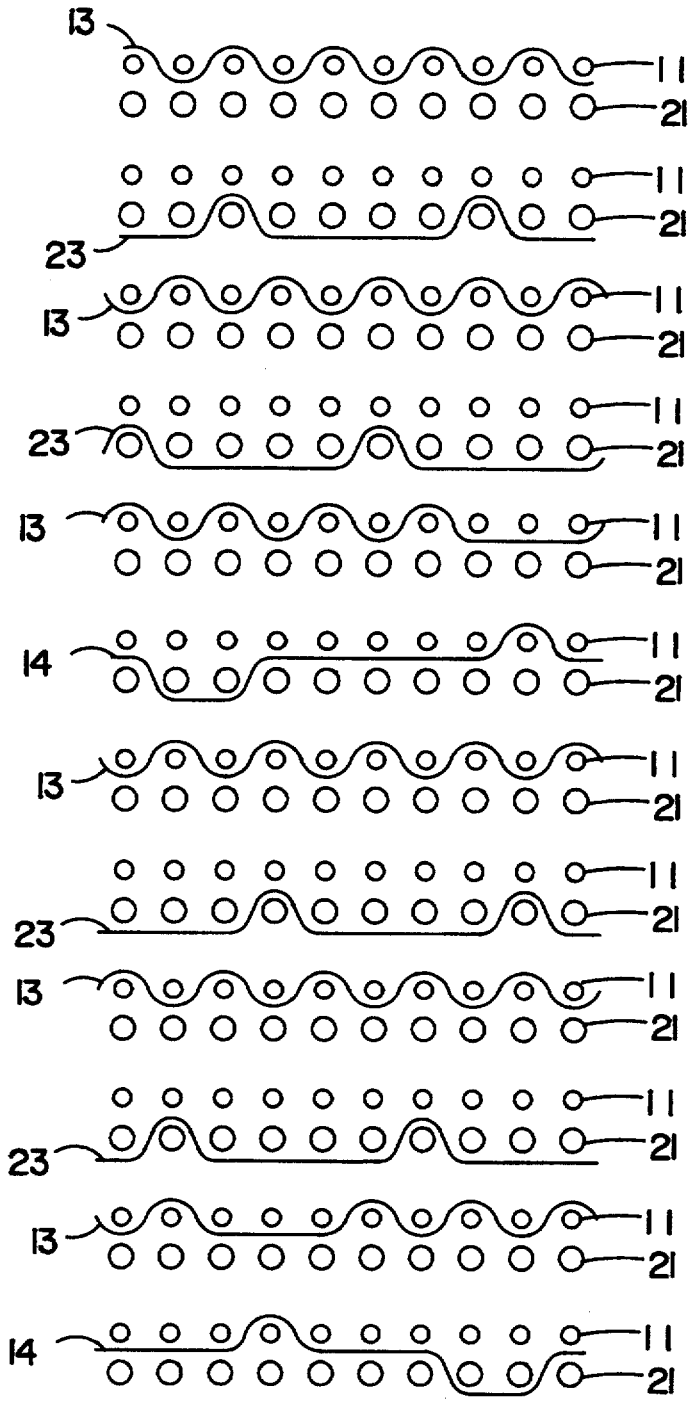
FIG. 6 is a sectional view of one group of the cross machine direction yarns in the preferred embodiment of the present invention shown in FIGS. 4 and 5.

FIG. 6 shows a sectional view of one group in the weave pattern of the cross machine direction yarns of the papermaking fabric shown in FIGS. 4 and 5. Several paths of the sheet side cross machine direction yarns 13, machine side cross machine direction yarns 23 and stitch yarns 14 are shown. From the figure, it is clear that the top cross machine direction yarn knuckle is dropped adjacent to the stitch knuckle on the sheet side surface. Accordingly, at that point, the hole between the yarn knuckle remains open to a maximum degree. Drainage is not impeded.

In all cases it is understood that the above-identified embodiments are merely illustrative of the many possible specific embodiments which represent applications of the present invention. Numerous and varied other arrangements can readily be devised in accordance with the principles of the present invention without departing from the spirit and scope of the invention.

What is claimed is:

1. A triple layer papermakers fabric for use in the forming section of a papermaking machine comprising:

a top fabric layer including machine direction yarns interwoven with cross machine direction yarns;

a bottom fabric layer including at least one set of machine direction yarns interwoven with at least one set of cross machine direction yarns;

a binder yarn extending generally parallel with the cross machine direction yarns in the top fabric layer and bottom fabric layer and interweaving with the top fabric layer and bottom fabric layer;

wherein, the binder yarn replaces the cross machine direction yarn of the top fabric layer when said binder yarn engages the machine direction yarns of the top fabric layer.

2. The fabric of claim 1 wherein the cross machine direction yarns of the top fabric layer have a diameter from 0.11 to 0.16 mm and the machine direction yarns of the top fabric layer have a diameter from 0.12 to 0.14 mm and the cross machine direction yarns of the bottom fabric layer have a diameter from 0.23 to 0.32 mm and the machine direction yarns of the bottom fabric layer have a diameter from 0.20 to 0.22 mm.

3. The fabric of claim 2 wherein the top fabric layer is a plain weave and the bottom fabric layer is woven in a 5 harness (base 2) weave.

4. The fabric of claim 1 wherein the ratio of top fabric layer cross machine direction yarns to bottom fabric layer cross machine direction yarns is 3 to 2.

5. The fabric of claim 1 wherein the ratio of top fabric layer cross machine direction yarns to bottom fabric layer cross machine direction yarns is 1 to 1.

* * * * *